US007583812B2

(12) United States Patent
Honda et al.

(10) Patent No.: US 7,583,812 B2
(45) **Date of Patent: *Sep. 1, 2009**

(54) ELECTRO-ACOUSTIC CONVERTER AND ELECTRONIC DEVICE USING THE SAME

(75) Inventors: Kazuki Honda, Osaka (JP); Koji Sano, Osaka (JP); Kazuya Yamasaki, Osaka (JP); Kazutaka Kubo, Osaka (JP); Masahide Sumiyama, Osaka (JP)

(73) Assignee: Panasonic Corporation, Osaka (JP)

( * ) Notice: Subject to any disclaimer, the term of this patent is extended or adjusted under 35 U.S.C. 154(b) by 338 days.

This patent is subject to a terminal disclaimer.

(21) Appl. No.: 10/599,800

(22) PCT Filed: Jun. 22, 2005

(86) PCT No.: PCT/JP2005/011414

§ 371 (c)(1),
(2), (4) Date: Oct. 10, 2006

(87) PCT Pub. No.: WO2006/003821

PCT Pub. Date: Jan. 12, 2006

(65) Prior Publication Data

US 2007/0202742 A1 Aug. 30, 2007

(30) Foreign Application Priority Data

Jul. 1, 2004 (JP) ..... 2004-195190

(51) Int. Cl.
*H04R 25/00* (2006.01)

(52) U.S. Cl. ..... 381/396; 381/407; 381/394; 381/152; 381/409; 381/395

(58) Field of Classification Search ..... 381/409, 381/410, 431, 152, 394, 395, 396; 379/433.02, 379/433.05, 438

See application file for complete search history.

(56) References Cited

U.S. PATENT DOCUMENTS 4,420,706 A 12/1983 Siebold et al.

(Continued)

FOREIGN PATENT DOCUMENTS

| | | |
|---|---|---|
| EP | 1 120 991 A2 | 8/2001 |
| EP | 1 146 773 A2 | 10/2001 |
| EP | 05 73 8748 | 1/2009 |
| JP | 07-211937 | 8/1995 |
| JP | 08-317029 | 11/1996 |
| JP | 2000-149700 | 5/2000 |
| JP | 2003-037890 | 2/2003 |
| WO | WO 00/59263 | 10/2000 |

(Continued)

OTHER PUBLICATIONS

International Search Report for Application No. PCT/JP2005/011414, dated Oct. 11, 2005.

*Primary Examiner*—Suhan Ni
*Assistant Examiner*—Jasmine Pritchard
(74) *Attorney, Agent, or Firm*—RatnerPrestia

(57) ABSTRACT

In an electro-acoustic converter, a frame is bonded to the magnetic circuit, and the diaphragm is bonded to a circumferential edge of the frame. The voice coil is attached to the diaphragm and a part thereof is located in a magnetic gap of the magnetic circuit. The terminal is made of a sheet metal having spring property and electrical conductivity, and a part thereof is fixed to the frame. The terminal has a bent portion and a contact portion, and is electrically connected to the voice coil. The stopper is provided around a portion of the terminal at one side nearer to the frame than the bent portion, and protrudes from a surface of the frame where the contact portion of the terminal protrudes. The stopper restricts bending of the terminal to an extent within a threshold value of reversibility of a material the sheet metal.

8 Claims, 5 Drawing Sheets

U.S. PATENT DOCUMENTS

| | | | | |
|---|---|---|---|---|
| 4,738,625 | A | 4/1988 | Burton et al. | |
| 6,553,126 | B2 * | 4/2003 | Han et al. | 381/409 |
| 6,671,384 | B1 | 12/2003 | Klein | |
| 6,674,872 | B2 | 1/2004 | Fujinami et al. | |
| 6,807,282 | B2 * | 10/2004 | Kaneda et al. | 381/396 |
| 6,860,766 | B2 * | 3/2005 | Aujla et al. | 439/733.1 |
| 7,181,040 | B2 * | 2/2007 | Ohta | 381/398 |
| 7,200,241 | B2 * | 4/2007 | Fukuyama et al. | 381/407 |
| 7,412,121 | B2 * | 8/2008 | Rahman | 385/14 |
| 2001/0009585 | A1 | 7/2001 | Masuda et al. | |
| 2001/0028303 | A1 | 10/2001 | Kuwabara et al. | |
| 2004/0037441 | A1 | 2/2004 | Konishi et al. | |
| 2005/0152536 | A1 * | 7/2005 | Caveney | 379/438 |
| 2006/0177092 | A1 | 8/2006 | Ohta | |
| 2007/0080412 | A1 | 4/2007 | Honda et al. | |

FOREIGN PATENT DOCUMENTS

| | | |
|---|---|---|
| WO | WO2005-107316 | 11/2005 |
| WO | WO2005-107317 | 11/2005 |
| WO | WO2005-115047 | 12/2005 |

* cited by examiner

ELECTRO-ACOUSTIC CONVERTER AND ELECTRONIC DEVICE USING THE SAME

This application is a U.S. NATIONAL PHASE APPLICATION OF PCT INTERNATIONAL APPLICATION PCT/JP2005/011414.

TECHNICAL FIELD

The present invention relates to an electro-acoustic converter used in an audio apparatus or a data communications apparatus of various kinds, and also an electronic device such as a mobile telephone and an electronic game machine.

BACKGROUND ART

FIG. 6 is a cross-sectional view of a conventional electro-acoustic converter used as a loud speaker or a receiver incorporated in an electronic device such as a mobile telephone. Magnet 1 is sandwiched between upper plate 2 and yoke 3 to configure magnetic circuit 4 of an inner-magnet type. Yoke 3 is press-fitted into frame 6 made of a resin material and bonded with adhesive. Diaphragm 7 is fixed to a circumferential edge of frame 6. Voice coil 8 for vibrating diaphragm 7 is attached to diaphragm 7 in a manner that it is located in magnetic gap 5 of magnetic circuit 4.

A lead wire of voice coil 8 is connected to one end of terminal 10 by soldering. Frame 6 retains a part of terminal 10 in its molded structure. Terminal 10 is bent over at bent portion 10A so as not to protrude outward from a boundary of an outer dimension of frame 6. Terminal 10 is formed by a process of bending a piece of sheet metal, and movable end 10B is used to make contact with an power supply section of a system by taking advantage of a spring tension of the sheet metal. Frame 6 is provided with stopper 9 protruding from the lower end thereof, which is formed unitary with frame 6 during a process of injection-molding the resin material.

Stopper 9 restricts a bending range of terminal 10 so as to prevent it from being bent beyond a threshold value of reversibility of a material of the sheet metal constituting terminal 10. This prevents terminal 10 from being bent to any such degree that exceeds the threshold value of reversibility even when loud speaker 11 is forcibly pressed while being mounted to an apparatus. It thus clears such drawbacks as terminal 10 getting damaged when loud speaker 11 is mounted to an apparatus, and terminal 10 becoming unstable to maintain contact with the apparatus due to a deficiency of spring tension of terminal 10. Loud speaker 11 illustrated above is disclosed in, for example, Japanese Patent Unexamined Publication, No. 2003-37890.

When an apparatus incorporating loud speaker 11 is accidentally dropped, however, there may be a possibility that stopper 9 becomes broken due to an excessive force of impact. If stopper 9 is broken in this way, it may cause metal terminal 10 to exceed the threshold value of reversibility of the spring tension, thereby resulting in an unstable contact with the power supply section of the apparatus. As a consequence, there can be a failure of contact, which interrupts signals whenever the apparatus is subjected to an impact or a vibration.

SUMMARY OF THE INVENTION

An electro-acoustic converter of the present invention has a magnetic circuit, a diaphragm, a voice coil, a terminal, and a stopper. A frame is bonded to the magnetic circuit, and the diaphragm is bonded to a circumferential edge of the frame.

The voice coil is attached to the diaphragm in a manner that a part of it is located in a magnetic gap of the magnetic circuit. The terminal is made of a sheet metal having both spring property and electrical conductivity, and a part of it is fixed to the frame. The terminal has a bent portion and a contact portion, and it is electrically connected to the voice coil. The stopper is provided around a portion of the sheet metal constituting the terminal at one side nearer to the frame than the bent portion, and it protrudes from a surface of the frame where the contact portion of the terminal protrudes. The stopper restricts bending of the sheet metal constituting the terminal to an extent within a threshold value of reversibility of a material of the sheet metal. The stopper of this reinforced structure limits deformation of the stopper itself to a smallest possible extent. This prevents the stopper from being deformed or damaged even if a thrusting dimension of the electro-acoustic converter is set to an increased value when mounting it to the apparatus, or if an excessively large impact is applied to the electro-acoustic converter and the terminal when the electronic device such as a mobile telephone is accidentally dropped. The present invention also includes an electronic device provided with an electro-acoustic converter of the type discussed above and an electronic circuit for supplying power to the electro-acoustic converter.

DETAILED DESCRIPTION OF THE PREFERRED EMBODIMENT

Figure 1:
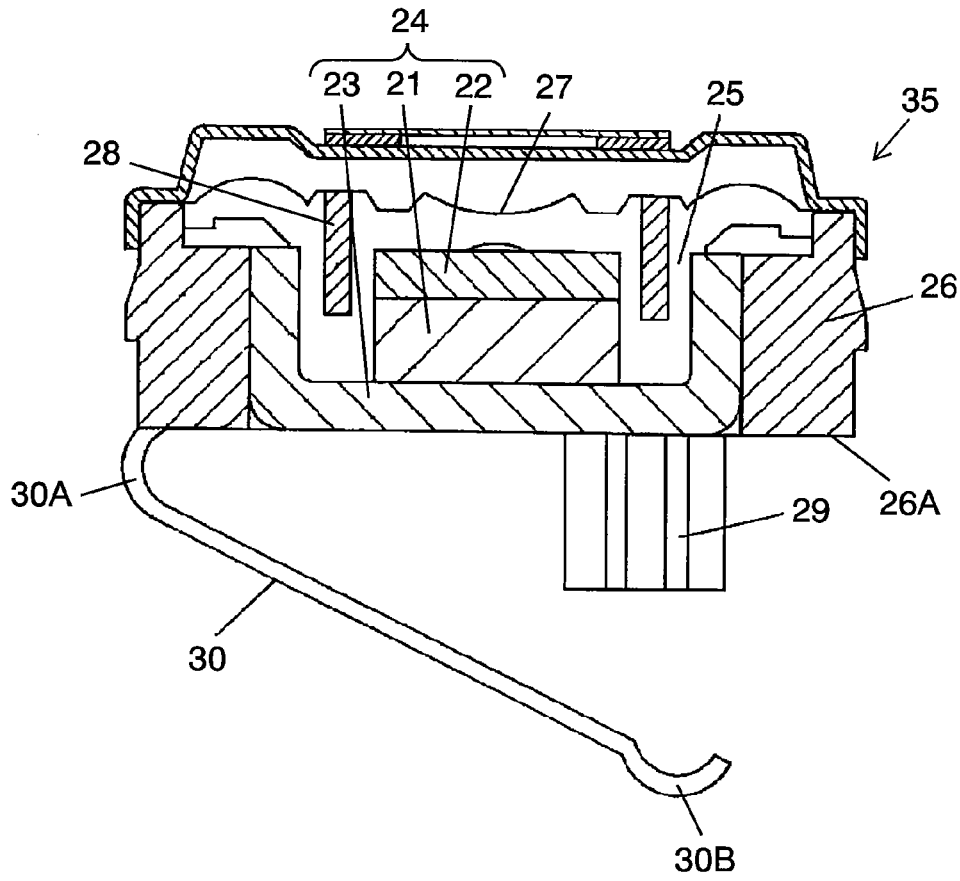
FIG. 1 is a cross-sectional view of a loud speaker according to an exemplary embodiment of the present invention.
Figure 2:
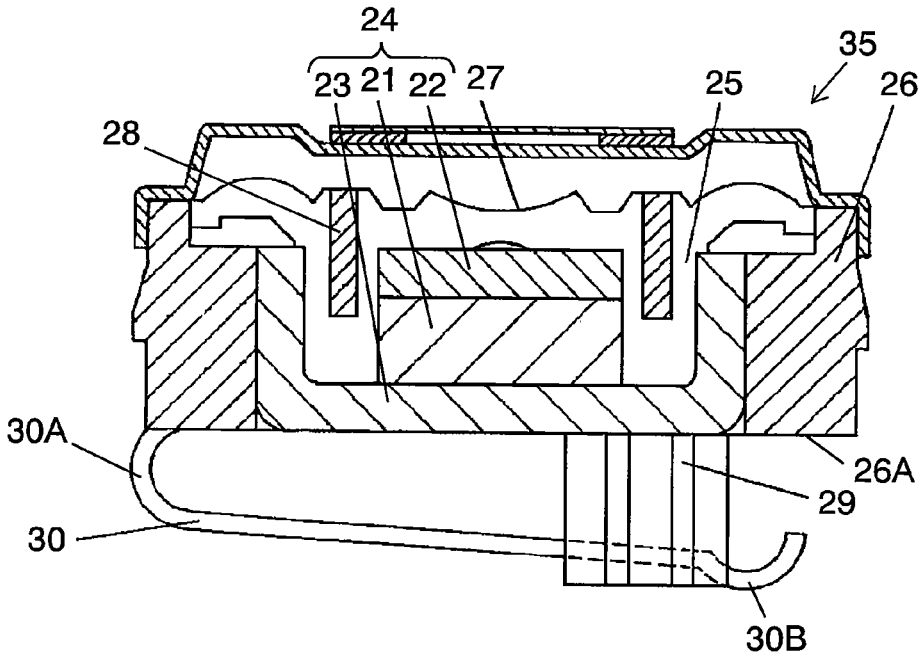
FIG. 2 is a cross-sectional view of the loud speaker shown in FIG. 1 with a terminal in a state of being bent.
Figure 3A:
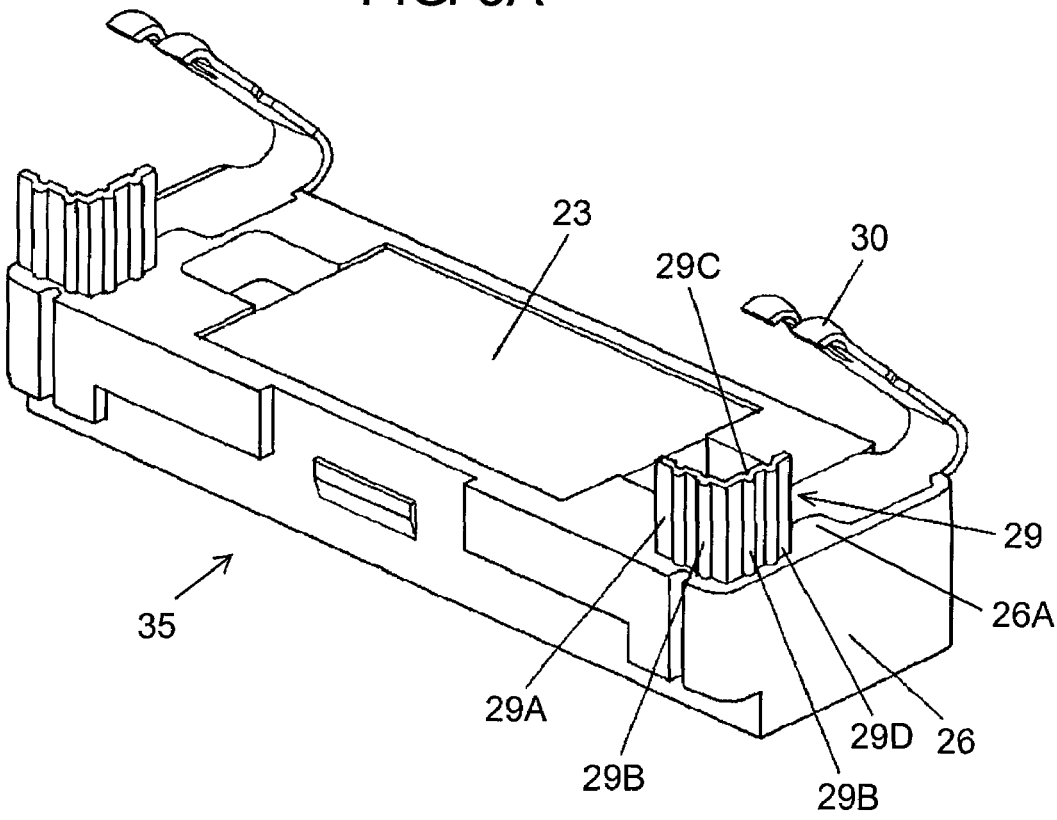
FIG. 3A is a perspective view of the loud speaker shown in FIG. 1.

FIG. 1 and FIG. 2 are cross-sectional views depicting a loud speaker as an electro-acoustic converter according to an exemplary embodiment of the present invention, in which FIG. 1 shows the loud speaker with a terminal in a relaxed state without a stressing force on it, and FIG. 2 shows the terminal in a state of being bent to its bottom dead point. FIG. 3A is a perspective view of the same loud speaker. Although a typical example shown in this exemplary embodiment is the loud speaker of a slim type having an exterior shape of rectangle, this invention is not limited only to this example.

Magnet 21 is sandwiched between upper plate 22 and yoke 23 to configure magnetic circuit 24 of an inner-magnet type. Yoke 23 constituting a part of magnetic circuit 24 is press-fitted into frame 26 made of a resin and bonded to it with adhesive. Diaphragm 27 is bonded (glued) to a circumferential edge of frame 26. Voice coil 28 configured to drive diaphragm 27 is attached to diaphragm 27 and a part of it is located in magnetic gap 25 of magnetic circuit 24. Although FIGS. 1 and 2 show the magnetic circuit formed into the inner-magnet type, it can also be an outer-magnet type.

A lead wire of voice coil 28 is electrically connected to terminal 30 by soldering. A part of terminal 30 is embedded in frame 26 and secured to it. Terminal 30 is bent over at bent portion 30A so as not to protrude outward from a boundary of an outer dimension of frame 26. Terminal 30 is formed by a process of bending a piece of sheet metal having spring property and electrical conductivity, and makes contact with a power supply section of an apparatus by taking advantage of a spring tension of the sheet metal at contact portion 30B. Terminal 30 is constructed of a sheet metal of such a material as phosphor bronze and copper-titanium alloy, which has both properties of electrical conductivity and spring property. Besides any one of the above unitary materials, terminal 30 may be made of a clad material using a good conductive material such as copper or gold plating on one side serving contact portion 30B, and another material such as spring steel or titanium having superior spring property on the other side thereof.

Stopper 29 is formed by a process of bending at least a part of the periphery of the sheet metal constituting terminal 30 into an angle substantially perpendicularly at one side nearer to frame 26 than bent portion 30A. This structure makes stopper 29 of terminal 30 abut upon and restricts further movement of loud speaker 35 even when loud speaker 35 is pushed forcibly for mounting. Stopper 29 thus restricts bending of the sheet metal constituting terminal 30 to an extent not exceeding a threshold value of reversibility of the metal material.

This structure also prevents stopper 29 from being deformed or damaged even when the electronic device such as a mobile telephone is accidentally dropped, which produces an excessively large impact upon terminal 30. As a result, stopper 29 keeps terminal 30 from being bent beyond the threshold value of reversibility of the spring tension of metal terminal 30, thereby avoiding terminal 30 from loosing its spring tension.

Stopper 29 is formed in a manner to protrude from surface 26A of frame 26 where terminal 30 protrudes. It is preferable that stopper 29 protrudes in a direction substantially perpendicular with respect to surface 26A, as described above. In this configuration, stopper 29 supports loud speaker 35 substantially perpendicularly against a pressure impressed upon it by the power supply section of the electronic device such as a mobile telephone. This structure not only protects terminal 30, but also reduces deformation of stopper 29 itself to a minimum extent. It is also desirable that edge face 29C opposite to surface 26A is substantially parallel to surface 26A. Stopper 29 can thus carry a weight of loud speaker 35 with the entire surface of edge face 29C. Any of the above structures helps avoid stopper 29 from being deformed when loud speaker 35 is mounted while being depressed with an excessively large force.

Figure 3B:
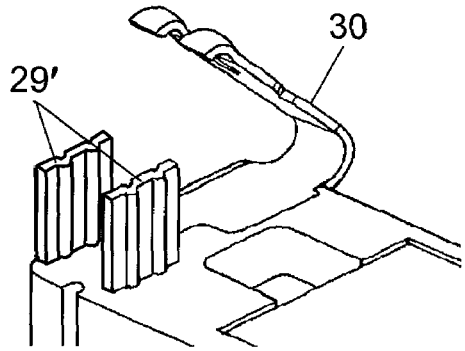
FIG. 3B is an enlarged perspective view depicting a main portion around a stopper of another configuration according to the exemplary embodiment of the present invention.

In FIG. 1, the embodiment shown is provided with stopper 29 at one location for each terminal 30. However, stoppers may be provided at two or more locations, for instance as shown in FIG. 3B, wherein stoppers 29' are formed at two confronting sides of the metal that constitutes terminal 30. This structure further reduces the possibility of the stoppers to get deformed.

In addition, stopper 29 may be so constructed as to form a reinforcing portion referred to as surface 29A by further bending at least a part of stopper 29 into an angle substantially orthogonal, as shown in FIG. 3A. In other words, it is desirable that stopper 29 has two surfaces 29A and 29D which are orthogonal with respect to each other when viewed from the front side of surface 26A. The provision of reinforcing portion 29A further improves strength of stopper 29. However, surfaces 29A and 29D need not be orthogonal to each other, but any angle greater than 0° but less than 180° formed between them provides a similar effect.

Moreover, any of stopper 29 and reinforcing portion 29A may be provided with reinforcing rib 29B, as shown in FIG. 3A. Reinforcing rib 29B is to be formed substantially in parallel with a direction, to which stopper 29 protrudes from frame 26. This structure further improves strength of stopper 29.

Figure 4:
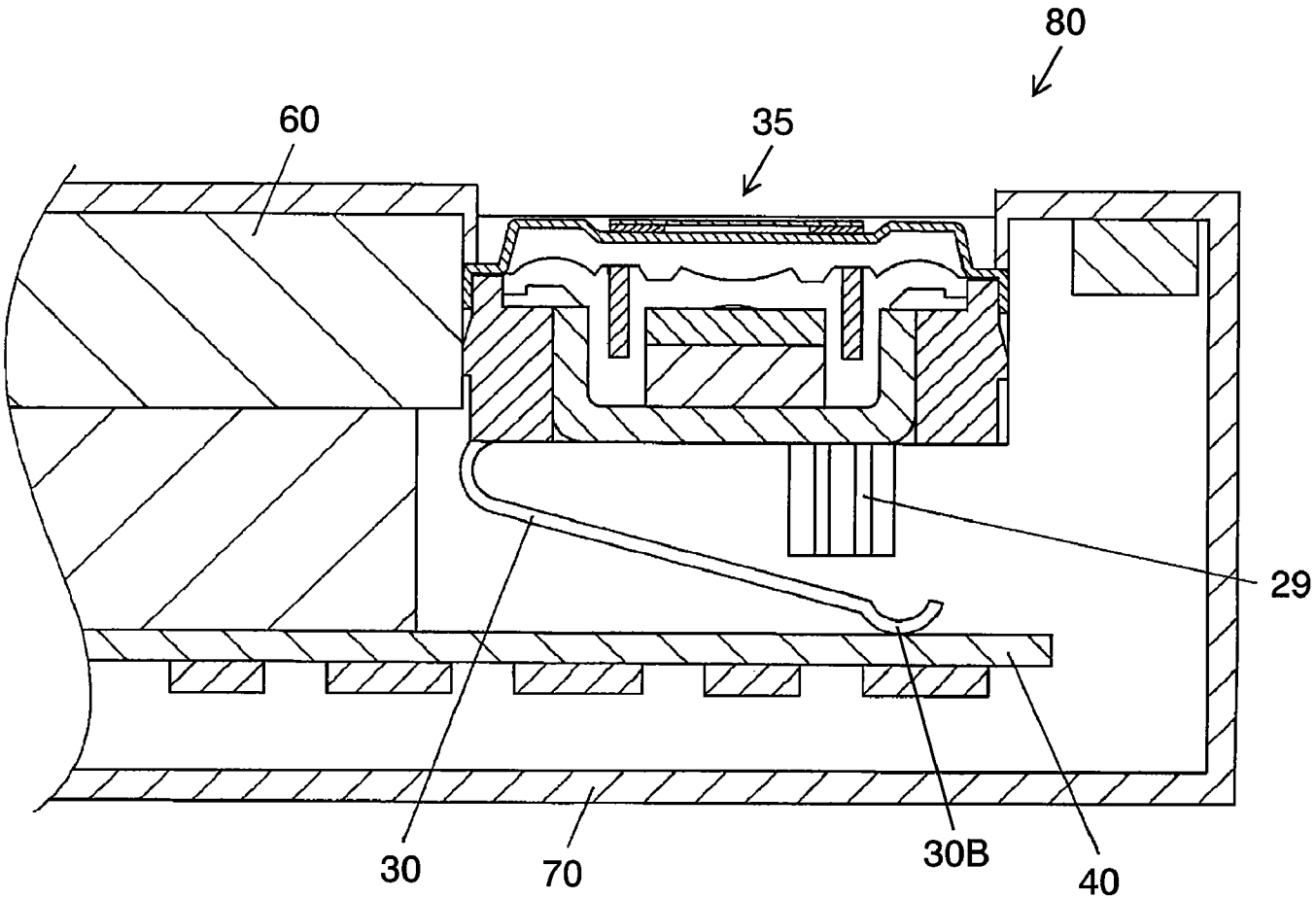
FIG. 4 is a cross-sectional view depicting a main portion of an electronic device according to the exemplary embodiment of the present invention.
Figure 5:
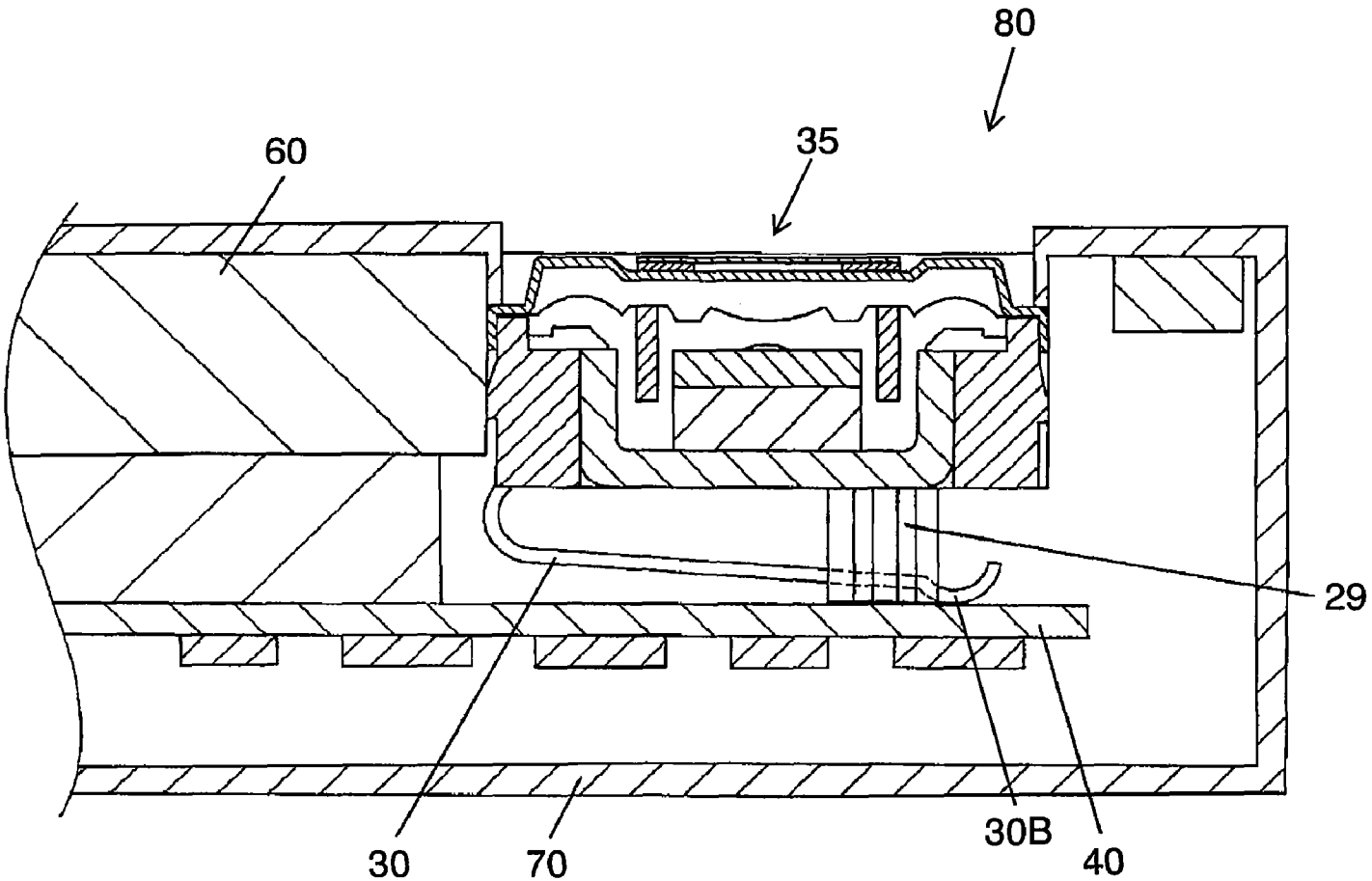
FIG. 5 is a cross-sectional view depicting the main portion of the electronic device shown in FIG. 4 with the terminal in a state of being bent.
Figure 6:
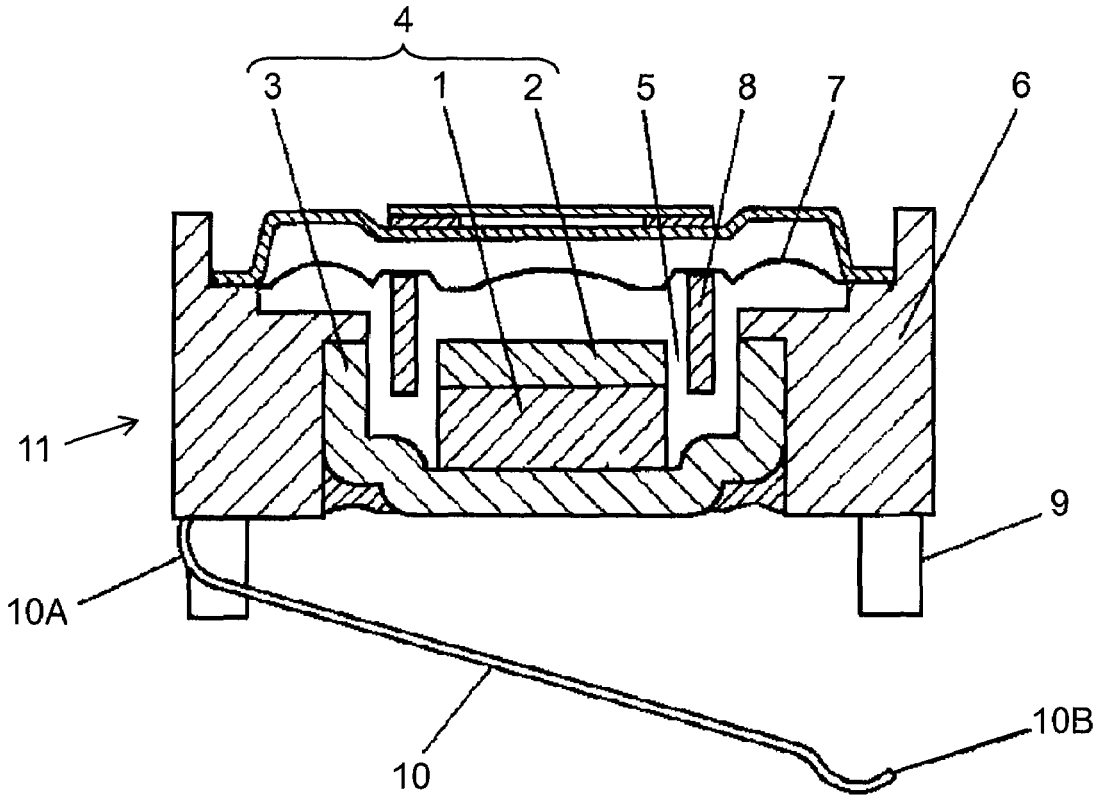
FIG. 6 PRIOR ART
FIG. 6 is a cross-sectional view of a conventional loud speaker.

Description is provided next of a structure wherein loud speaker 35 having stopper 29 is built into an electronic device. FIGS. 4 and 5 are cross-sectional views depicting a main portion of a mobile telephone according to the exemplary embodiment of this invention. Mobile telephone 80 representing the electronic device has loud speaker 35 mounted thereto.

Mobile telephone 80 has loud speaker 35, electronic circuit 40, and display module 60 such as a liquid crystal panel. These parts, module, and the like components are mounted inside of outer enclosure 70 to compose the main portion of mobile telephone 80. Terminal 30 of loud speaker 35 is in contact with electronic circuit 40 via contact portion 30B under the spring tension, and it completes an electrical connection between them. Electronic circuit 40 supplies an electric power for driving loud speaker 35 to generate sound.

According to this structure, stopper 29 prevents terminal 30 from being deformed excessively even if a depressing dimension of loud speaker 35 is set to an increased value when mounting loud speaker 35 to mobile telephone 80. The structure also prevents stopper 29 from being deformed or damaged even if an excessively large impact is applied to terminal 30 when mobile telephone 80 is accidentally dropped. In other words, terminal 30 is prevented from being bended to an extent exceeding the threshold value of reversibility of the spring tension of its sheet metal, so as not to weaken the spring tension of terminal 30. This threshold value is determined according to a bending angle of the sheet metal, a shape of bent portion 30A, strength of impressed load, i.e., stress, and a cycle of the impressed load.

Accordingly, terminal 30 can maintain its strong spring tension at all the time to ensure the stable contact continuity with the power supply section of electronic circuit 40 in mobile telephone 80. Since there is not likely any contact failure even when mobile telephone 80 receives impacts and vibrations, it operates steadily without any interruption of signals. As a result, the invention improves reliability and quality of the electronic device such as mobile telephone.

INDUSTRIAL APPLICABILITY

An electro-acoustic converter according to the present invention is suitable for use in an electronic device such as an audio video apparatus, data communications equipment, game machine, and the like device that require improvement of reliability and quality.

The invention claimed is:

1. An electro-acoustic converter comprising:

a magnetic circuit;

a frame bonded to the magnetic circuit;

a diaphragm bonded to a circumferential edge of the frame;

a voice coil attached to the diaphragm in a manner that a part thereof is located in a magnetic gap of the magnetic circuit;

a terminal made of a sheet metal having spring property and electrical conductivity, a part of the terminal being fixed to the frame and electrically connected to the voice coil, the terminal having a bent portion and a contact portion for connection to an external circuit; and a stopper having adjacent portions that protrude from a surface of the frame where the contact portion of the terminal protrudes, a portion of the terminal being disposed between the adjacent portions of the stopper wherein the stopper is configured to restrict bending of the sheet metal constituting the terminal within a threshold value of reversibility of a material of the metal.

2. The electro-acoustic converter according to claim 1, wherein the stopper protrudes substantially perpendicularly from the surface of the frame where the contact portion of the terminal protrudes.

3. The electro-acoustic converter according to claim 1, wherein an edge face of the stopper opposite to a surface of the frame where the contact portion side of the terminal protrudes is substantially parallel to the surface of the frame where the contact portion side of the terminal protrudes.

4. The electro-acoustic converter according to claim 1, wherein the stopper is one of a plurality of stoppers, and the terminal is provided with the plurality of stoppers.

5. The electro-acoustic converter according to claim 1, wherein the stopper has two surfaces with an angle greater than 0° but less than 180° formed therebetween when viewed toward the surface of the frame where the contact portion side of the terminal protrudes.

6. The electro-acoustic converter according to claim 5, wherein the two surfaces are substantially orthogonal with respect to each other.

7. The electro-acoustic converter according to claim 1 further comprising a reinforcing rib formed substantially in parallel with a direction in which the stopper protrudes from the frame.

8. An electronic device comprising:

an electro-acoustic converter having;

a magnetic circuit;

a frame bonded to the magnetic circuit;

a diaphragm bonded to a circumferential edge of the frame;

a voice coil attached to the diaphragm in a manner that a part thereof is located in a magnetic gap of the magnetic circuit;

a terminal made of a sheet metal having spring property and electrical conductivity, a part of the terminal being fixed to the frame and electrically connected to the voice coil, the terminal having a bent portion and a contact portion for connection to an external circuit; and a stopper having adjacent portions that protrude from a surface of the frame where the contact portion of the terminal protrudes, a portion of the terminal being disposed between the adjacent portions of the stopper wherein the stopper is configured to restrict bending of the sheet metal constituting the terminal within a threshold value of reversibility of a material of the metal, and an electronic circuit connected electrically with the electro-acoustic converter via the contact portion, electronic circuit being configured to supply electric power to the electro-acoustic converter.

* * * * *

UNITED STATES PATENT AND TRADEMARK OFFICE

CERTIFICATE OF CORRECTION

PATENT NO. : 7,583,812 B2
APPLICATION NO. : 10/599800
DATED : September 1, 2009
INVENTOR(S) : Honda et al.

It is certified that error appears in the above-identified patent and that said Letters Patent is hereby corrected as shown below:

On the cover page, item (56), References Cited, please insert:

--U.S. PATENT DOCUMENTS

| | | |
|---|---|---|
| 2001/0053233 A1 | 12/2001 | Fukazawa et al. |
| 7,415,121 B2 | 8/2008 | Mogelin et al.-- |

Signed and Sealed this

Fifteenth Day of December, 2009

David J. Kappos

David J. Kappos
*Director of the United States Patent and Trademark Office*